United States Patent [19]

Campbell

[11] 3,936,296

[45] Feb. 3, 1976

[54] INTEGRATED FLUIDIZED REDUCTION AND MELTING OF IRON ORES

[76] Inventor: Donald L. Campbell, 5 Cambridge Dr., Short Hills, N.J. 07078

[22] Filed: Feb. 25, 1970

[21] Appl. No.: 14,119

[52] U.S. Cl. ..... 75/26; 75/34; 75/38; 75/39

[51] Int. Cl.[2] ..... C22B 1/10; C21B 13/02

[58] Field of Search ..... 75/26, 34, 35, 38, 39

[56] References Cited

UNITED STATES PATENTS

| | | | |
|---|---|---|---|
| 2,894,831 | 4/1959 | Old | 75/26 |
| 3,145,094 | 8/1964 | Nakajima | 75/38 |
| 3,246,978 | 6/1966 | Porter | 75/26 |

FOREIGN PATENTS OR APPLICATIONS

| | | | |
|---|---|---|---|
| 828,314 | 8/1960 | United Kingdom | 75/26 |

*Primary Examiner*—Peter D. Rosenberg
*Attorney, Agent, or Firm*—Joseph J. Dvorak

[57] ABSTRACT

An integrated process for continuously making iron-containing materials is provided in which a finely-divided iron ore is at least partially reduced in a staged fluidized iron ore reduction process and subsequently transferred and further treated in a melting zone. A carbonaceous fuel and oxygen are reacted in the melting zone to generate sufficient heat to melt the added prereduced ore and also to generate a reducing gas rich in CO which is used to fluidize and prereduce the iron ore in the reduction zone. A carbonaceous fuel is mixed with the iron bearing material in the last stage of the reduction process to provide for absorption of excess heat from the hot reducing gases which are generated in the melting zone.

11 Claims, 2 Drawing Figures

*Donald L. Campbell* Inventor

By *[illegible]* Attorney

INTEGRATED FLUIDIZED REDUCTION AND MELTING OF IRON ORES

BACKGROUND OF THE INVENTION

In processing good quality iron ore in lump form to obtain higher iron content materials, such as steel and the like, generally two separate reactors are employed. The processing steps of drying, preheating, reducing, cementation, melting and refining of said ore are conventionally effected in one reactor, i.e., in a blast furnace, to produce pig iron. Subsequently the pig iron is processed in another furnace to provide molten steel.

In processing pulverized iron ore materials, the various processing steps such as drying, preheating and reducing the ore generally are effected in several distinct reaction zones provided in the same or separate reactors. For example, pulverized ore frequently is dried and preheated in a separate reactor or ore preheater. Next, the preheated ore is reduced by passing through a series of fluidized reduction zones, often provided in a single reactor. Thereafter, the finely-divided partially reduced ore is compacted in the form of briquettes. Then, briquettes are cooled under controlled conditions to prevent reoxidation of the reduced iron ore. Finally, the briquettes are ultimately utilized in steelmaking furnaces to produce molten steel.

Prereduced finely-divided iron ore is compacted for a variety of reasons including some relating to handling and storage of reduced metals. However, when the prereduced ore is to be charged in a blast furnace for subsequent processing, generally it is considered absolutely necessary that the prereduced ore be in a compacted form. Finely-divided prereduced ore would be swept out of a blast furnace by the heat reducing gases generated in the furnace.

Some processes have been suggested in the art for combining the reduction of pulverized iron ore containing materials with a melting and refining step to provide a more direct process for obtaining iron-containing materials.

In general, the combined reduction and melting of pulverized iron ore solids known to the art requires the use of a separate gasification zone in which either a reducing gas is generated by partially reacting a carbonaceous material with oxygen or steam, or a combustion gas from the melting zone is upgraded to provide a gas of sufficient reducing power with respect to the ore to be processed. Also, such process requires the use of special reactors to recycle and prevent the loss of finely-divided ore which is swept out of the melting furnace by hot combustion gases generated there.

SUMMARY OF THE INVENTION

This invention relates to an integrated process for continuously making high iron content materials from finely-divided iron ores in which the ore is partially reduced in a fluidized iron ore reduction process. Subsequently the partially reduced ore is transferred and processed in a melting, final reducing, and refining zone. Sufficient carbonaceous fuel is introduced into the melting, reducing and refining zone to complete the reduction of the transferred ore and to react with added oxygen to generate sufficient heat to melt the transferred partially reduced ore and to liberate a hot reducing gas which is rich in CO. The liberated reducing gas is transferred to fluidize and reduce the iron ore in the reduction zone thereby eliminating the need for a separate reducing gas generation zone.

In a preferred embodiment of the present invention a finely-divided prereduced iron ore is transferred from a final zone of a staged fluidized iron ore reduction process and introduced in a melting zone below the level of the molten iron to facilitate the complete melting of the iron-containing material and to prevent loss of the finely-divided iron material from the melting zone by being carried out in a gas stream such as the reducing gas stream generated therein.

In still another preferred embodiment of the present invention a CO containing reducing gas generated in the melting zone is introduced into the final stage of the fluidized ore reducion process at a point whereby coke and the partly reduced ore are mixed so that excess heat from the reducing gas will be absorbed by the endothermic reaction of reduced iron oxides in the ore with coke. In this way the fluidization and reduction of the solid materials can be conducted at temperatures below that at which individual ore particles begin to cling or weld together to form agglomerates. The temperature at which the particles will cling together is referred to herein as the effective fusing temperature. It is particularly important in the fluidized reduction of iron ore to conduct the reduction step below the effective fusing temperature of the ore to prevent agglomeration and the resulting loss of fluidization.

In still another embodiment of the present invention the reducing gas from the melting zone is first mixed with a recycle gas from said reducing zone to provide a reducing gas mixture having a temperature sufficient to maintain the temperature in the reducing zone below the effective fusing temperature of the ore.

These and other embodiments of the present invention will become more apparent from the detailed description of the invention which follows.

DETAILED DESCRIPTION OF THE INVENTION

Figure 1:
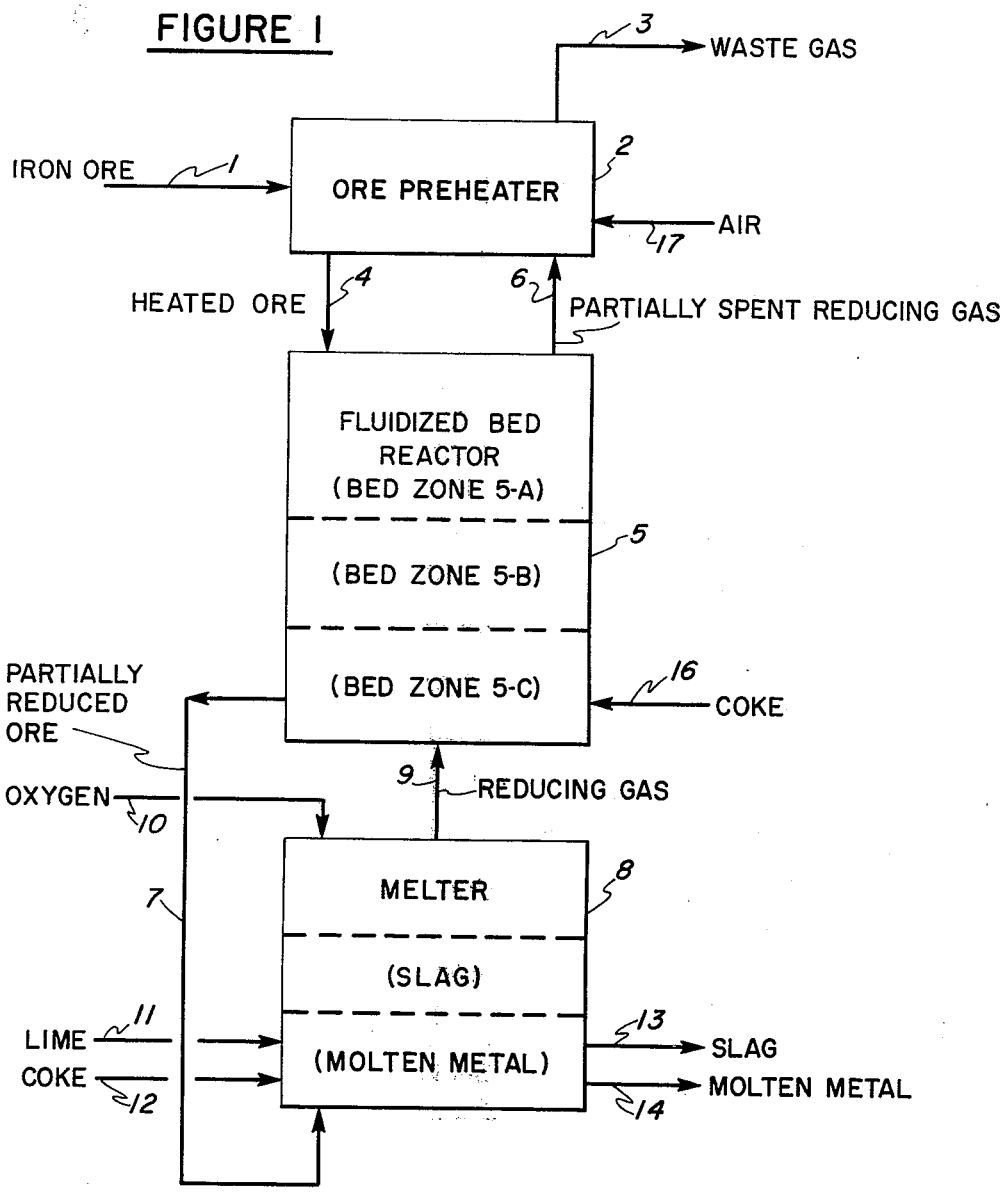
FIG. 1 is a schematic diagram illustrating a preferred embodiment of the process of the invention.

Referring to the FIG. 1, finely-divided iron ore which previously has been dried, ground and sized, is introduced into ore preheater 2 via line 1.

The ore which is used in this process may be any of the well-known iron-oxide-containing ores including, but not limited to hematite, limonite, and goethite. Such iron-oxide-containing ores include a small amount of gangue. Gangue is the mineral matter mined with the metal oxides. Gangue typically consists mostly of silica and alumina.

The drying, grinding and sizing of the ore is accomplished by any technique known in the art. The ore can be dried, for example, by heating the ore in a kiln to about 150°F. Selection of proper time and temperature for drying the ore will depend upon the allowable water content of the ore. Generally after drying the ore will contain less than 2 wt. percent water and preferably less than 1 wt. percent water.

Grinding can be achieved by subjecting the ore to gyratory, impact or autogenous crushing and the like. Sizing of the ore is accomplished generally by screening.

For the purpose of this invention the ore is properly sized for fluidization in the reduction reactor. The fine-divided ore consists of particles having diameters essentially below about 25,000 microns in size. The average particle size will range generally from about 200 to 500 microns in size. Preferably the particle sizes will range from 6000 microns in size and finer with no more than 10 wt. percent of particles below 44 microns in size.

In the preheater 2, the finely-divided ore generally is fluidized and heated for about 15 minutes at a temperature of about 1100° to 1600°F., preferably at about 1200° to 1500°F. and more preferably at about 1450°F. The temperature is maintained in ore preheater 2 by the combustion of partially spent reducing gas with air. The reducing gas is introduced in preheater 2 through line 6 and the air is introduced through line 17.

The preheated ore then is delivered via line 4 to fluidized bed reactor 5. Next, the heated ore is permitted to flow downwardly in reactor 5 while being reduced, at least partially, by hot, ascending, reducing gases introduced via line 9. This reduction is accomplished with a CO rich reducing gas at temperatures below the effective fusing temperature of the ore to prevent undesirable agglomeration. Generally, the reduction is conducted below about 1900°F. and preferably at from about 1400°F. to about 1600°F. Typically, several reducing beds are arranged as separate reduction zones within a single reactor, such as reactor 5. For example, three reducing beds are shown in the reactor 5 and they are designated as 5-A, 5-B and 5-C. The number of reducing beds provided is a matter of choice and depends upon the nature of the ore being processed, the quality of the product desired and the type of reducing gas employed, among other factors. Alternatively, individual reactors connected in series may be provided.

In any event, iron ore is introduced into the top of the reactor, or reactors and flowed downwardly from bed to bed with a progressively lower oxidation state of the ore within each zone being achieved as the ore comes in contact with the ascending fluidizing reducing gas.

The proper temperature for the reducing step depends upon several factors. One factor effecting selection of the proper reducing temperature is the reducing gas composition. The reduction of iron ore, for example, is known to occur at relatively low temperatures with a CO rich reducing gas mixture. Another factor that must be considered is the effective fusing temperature of the ore. In order to prevent agglomeration that will result in loss of fluidization, the reduction must be conducted below the effective fusing temperature or temperatures where agglomeration of the ore occurs.

The reducing gas is generated in melter 8 by the interaction of a carbonaceous fuel with the residual oxygen in the partially reduced ore and by interaction of the fuel with oxygen introduced in the melting zone via lines 10 and 12 as will later be described. The reducing gas has a $CO/CO_2$ mole ratio generally of from about 4:1 to about 9:1, preferably from about 4:1 to about 4.5:1. The reducing gas is evolved at a temperature in the range generally of 2600° to 3000°F., and preferably in the range of 2700° to 2900°F.

Figure 2:
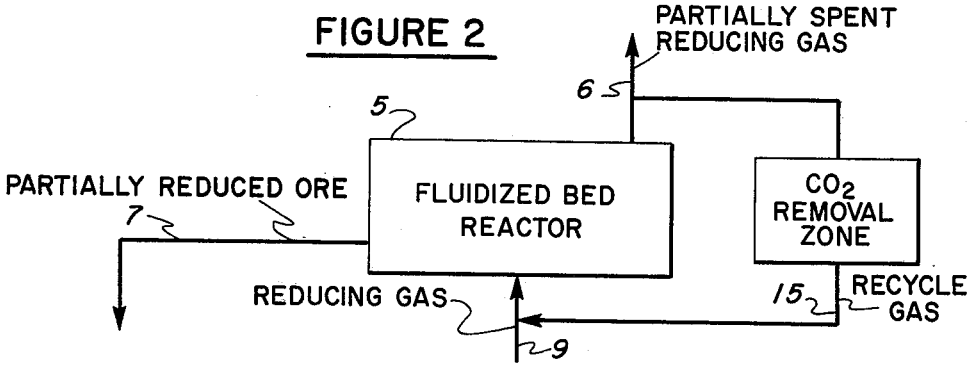
FIG. 2 is a schematic diagram of a segment of the process of the invention illustrating one possible modification of the FIG. 1 process. Although the process will be described by reference to the Figures, the invention is not intended to be limited thereby.

Prior to introduction of the reducing gas by line 9 into the final stage or bed of fluidized bed reactor 5, the reducing gas optionally is mixed with recycle or effluent gas from the reducing reactor. The recycle gas is introduced into line 9 via line 15. The partially spent reducing gas leaving the first reduction stage via line 6 which is recycled via line 15 preferably is treated to remove $CO_2$ before introduction in line 9. Treatment of the recycle gas is shown schematically in FIG. 2 as a $CO_2$ removal zone. In any event, recycle gas optionally is mixed with the reducing gas to be introduced into the final stage of reactor 5, to provide a gas mixture having a temperature sufficient to maintain the reducing zones of reactor 5 in the range of 1200° to 1900°F. and preferably in the range of 1400° to 1600°F.

Partially spent reducing gas leaving the first reduction stage via line 6, which is not recycled as previously described, is introduced into ore preheater 2 and combusted in the ore preheater with air introduced via line 17. The combustion of the reducing gas with air in the preheater is an exothermic reaction and the heat generated is thereby efficiently utilized in preheating the ore.

As a preferred embodiment of the present invention, the reducing gas is introduced by line 9 into the final reducing stage or bed of reactor 5. Coke also is introduced into the final reducing stage of reactor 5 via line 16 and mixed with the partially reduced iron ore. The temperature of the reducing gas stream is effectively lowered by the endothermic reaction of coke and iron ore in the final bed so that the temperature in the reactor 5 can be maintained below about 1900°F., preferably at from about 1400°F. to about 1600°F. The partially reduced iron ore which is mixed with coke in the final bed of the reactor is obtained from the next preceding fluidized iron ore reduction bed in a multiple bed reactor. For example, the ore admixed with coke in bed 5-C of reactor 5 has been obtained from bed 5-B of reactor 5.

As mentioned previously, the temperature in reduction reactor 5 is maintained below about 1900°F. to prevent agglomeration which results in loss of fluidization of the ore. The pressure at which the reducing gas is delivered for fluidization of the ore depends upon the operating pressure selected for the entire system including the pressure desired for the preheater, reduction reactor and melter. Typically, the reducing gas is introduced into the bottom of the reactor at a pressure greater than about 2 atm. absolute. A pressure greater than 30 atm. generally is not employed. Preferably the gas is introduced into the reactor at a pressure in the range of from about 3 to about 10 atm.

After the finely-divided iron ore is partially reduced, the solilds are pressurized with reducing or inert gas and delivered via line 7 to melter 8. In general, the prereduced ore will be from about 30 percent to about 85 percent metallized when delivered to melter 8. However, the extent to which the ore is prereduced before delivery to melter 8 depends primarily upon whether reducing gas is recycled via line 15 as previously described. When the reducing gas is recycled, the prereduced ore is in the range of about 65 percent to about 85 percent metallized; whereas, when little or no reducing gas is recycled, the prereduced ore is in the range of about 30 percent to about 50 percent metallized.

The extent that the ore is metallized, or the percent metallization, refers to the percentage of the total iron in the ore which is present as elemental iron.

In a preferred embodiment of this invention, the prereduced iron ore from the final reduction stage is introduced below the molten metal in melter 8 thereby preventing entrainment of the finely-divided solid in the gas stream generated in melter 8. The finely-divided prereduced ore from reactor 5 generally is at a temperature below 1900°F. and preferably in the range of about 1400°F. to about 1600°F.

Lime for slagging can be introduced into the melter 8 by line 11. Optionally, lime can be added through an oxygen lance. The amount of lime and other additives to be added depends upon the chemistry of the ore and the desired molten product and proper selection is within the ordinary skill of the art. In addition to lime, other materials may be added such as calcium fluoride for controlling slag quality, and manganese or other additives used in making iron alloys such as steel and the like.

A carbonaceous fuel, preferably coke, is fed into melter 8 through line 12 and oxygen is introduced into the melter via line 10 through an oxygen lance (not shown). The coke and oxygen are introduced at a rate sufficient to generate the requisite heat to melt and to effect the final reduction of the prereduced iron ore and also to generate a reducing gas having a mole ratio, as previously specified, of carbon monoxide to carbon dioxide most generally of about 4:1 to about 9:1, and preferably from about 4:1 to about 4.5:1. A CO rich containing gas is required to effect rapid reduction of the iron ore to about 30 percent metallization or more at temperatures generally below the effective fusing temperature of the finely-divided ore.

The prereduced ore introduced into melter 8 is finely-divided at an elevated temperature. Consequently, melting, reducing and refining of the prereduced ore is extremely rapid. Advantageously then, the other materials introduced into the melter such as coke, lime and oxygen are preheated also by any convenient means. Obviously, the lower the extent metallization of the ore introduced into the melter, the more advantageous preheating the other materials will be in achieving thermal efficiency.

The reducing gas is withdrawn from melter 8 by line 9. The gas is at a temperature generally in the order of about 2600° to 3000°F. Since it is desirable to maintain the bed temperature in the fluidized bed reactor generally in the range of about 1400°F. to about 1600°F., the reducing gas is introduced by line 9 into the bottom of reactor 5 in the manner previously described.

The hot waste gas removed via line 3 may be further processed for sensible heat recovery.

Finally, slag is removed as required from melter 8 via line 13 and the molten iron-containing material is recovered by withdrawal through line 14.

Optionally, melter 8 can be provided with a separate chamber or accumulator where additional fluxes or alloys are added to adjust the chemical composition of the molten steel product. An accumulator separate from melter 8 can even be provided and the temperature maintained therein by techniques such as oxygen lancing. Generally and preferably, however, chemical composition of the molten iron-containing material is adequately adjusted in melter 8. Thus controlled amounts of lime can be added, for example, to control the lime to gangue ratio and effect desulfurization and any necessary dephosphorization. Additional carbonaceous material can be added to adjust the carbon content of the molten iron-containing material. Generally, the iron-containing material will have a carbon content of about 0.05 percent to about 4.3 percent.

I claim:

1. A method of reducing and refining iron ore by combining separate reducing refining zones whereby the gas generated in the refining zone is used to fluidize and partially reduce finely divided iron ore in the reduction zone at temperatures below about 1900°F. and the partial reduced ore is subsequently transferred and processed in the refining zone, the improvement comprising:

a. introducing the partially reduced iron ore transferred from the reducing zone and processed in the refining zone below the molten iron-containing metal in the refining zone;

b. introducing a carbonaceous fuel and oxygen in the refining zone to generate sufficient heat to melt and refine the transferred partially reduced iron ore and to liberate a reducing gas having a $CO/CO_2$ ratio of from about 4:1 to about 9:1 at a temperature of about 2600°F. to 3000°F., and c. transferring said reducing gas from the refining zone to fluidize and partially reduce the iron ore in the reducing zone to a metallization ranging from about 30 pecent to about 85 percent.

2. The process of claim 1 wherein the carbonaceous fuel is coke.

3. The process of claim 1 wherein the reducing gas is transferred to the bottom of the reducing zone to fludiize coke mixed with iron ore so as to maintain the temperature in the reducing zone in the range of about 1400°F. to about 1600°F. and wherein the partially reduced ore transferred to the refining zone is from about 30 percent to about 50 percent metallized.

4. The process of claim 1 wherein the transferred reducing gas is admixed with a recycle gas from the reducing zone therby providing a reducing gas for fluidization of the iron ore which will maintain the temperature in the reducing zone in the range of about 1400°F. to about 1600°F and wherein the partially reduced ore transferred to the refining zone is from about 65 percent to about 85 percent metallized.

5. The process of claim 1 wherein the amount of carbonaceous fuel also is controlled to provide a molten iron-containing material having a carbon content in the range of from about 0.05 percent to about 4.3 percent.

6. A process for making iron-containing materials for finely divided iuron ore by combining separate reducing and refining steps and comprising the steps of:

a. fluidizing the iron ore in the reduction zone with a reducing gas to effect a partial reduction of the iron ore at temperatures below about 1900°F. to a metallization in the range from about 30 percent to about 85 percent;

b. transferring the partially reduced iron ore from the reduction zone to a refining zone for melting and processing;

c. introducing the iron ore transfer from the reducing zone to the melting zone below the molten metal in the melting zone;

d. introducing carbonaceous fuel and oxygen into the refining zone to generate sufficient heat for melting, and finally reducing the partially reduced ore and to liberate a hot CO rich reducing gas at a temperature range of about 2600°F. to 3000°F. and having a $CO/CO_2$ mole ratio of about 4:1 to about 9:1;

e. transferring said reducing gas from a refining zone to the reduction zone to fluidize and partially reduce the iron therein; and f. recovering a molten iron-containing material.

7. The process of claim 6 wherein a carbonaceous fuel and oxygen introduced in the refining zone in Step (d) is adjusted to provide a reducing gas with a $CO/CO_2$ mole ratio of from about 4:1 to about 9:1 at a temperature of about 2600° to 3000°F.

8. The process of claim 7 further characterized by admixing the transferred reducing gas of step (e) with coke and iron ore in the bottom of the reducing zone whereby the temperature in the reducing zone is maintained in the range of about 1400°F. to about 1600°F. and in which transferred ore of step (b) is about 30 percent to about 50 percent metallized.

9. The process of claim 7 wherein the reducing gas transferred from the refining zone to the reducing zone is mixed before introduction in the reducing zone with a recycle gas from said zone to provide a reducing gas mixture having a temperature sufficient to maintain the temperature in the reducing zone in the range of about 1,400°F. to about 1600°F. and wherein the ore transferred in step (b) is about 65 percent to about 85 percent metallized.

10. The process of claim 6 including the steps of controlling the carbon content in the refining zone to provide a molten iron containing material having a carbon content of from about 0.05 wt. percent to about 4.3 wt. percent.

11. The process of claim 6 including the steps of providing lime and process additives in the refining zone to obtain a molten iron-containing material and slag.

* * * * *